US008360267B1

(12) United States Patent
Chiou et al.

(10) Patent No.: US 8,360,267 B1
(45) Date of Patent: Jan. 29, 2013

(54) DRINKING CONTAINER HAVING LOCKING DRINKING ORIFICE AND VENT APERTURE

(75) Inventors: Joe Chiou, Wilmette, IL (US); Sami M. El-Saden, Winnetka, IL (US)

(73) Assignee: Ignite USA, LLC, Chicago, IL (US)

( * ) Notice: Subject to any disclaimer, the term of this patent is extended or adjusted under 35 U.S.C. 154(b) by 0 days.

(21) Appl. No.: 13/219,140

(22) Filed: Aug. 26, 2011

(51) Int. Cl.
*A47G 19/22* (2006.01)
*H04M 1/02* (2006.01)

(52) U.S. Cl. ..... 220/715; 220/711; 220/712; 220/713; 220/714; 379/433.12

(58) Field of Classification Search ..... 206/1.5; 215/207, 383; 220/715, 252, 260, 200, 711–714; 292/302; 379/433.12
See application file for complete search history.

(56) References Cited

U.S. PATENT DOCUMENTS

| | | | |
|---|---|---|---|
| 3,964,631 | A | 6/1976 | Albert |
| 3,967,748 | A | 7/1976 | Albert |
| 4,276,992 | A | 7/1981 | Susich |
| 4,303,173 | A | 12/1981 | Nergard |
| 5,427,271 | A | 6/1995 | Wang |
| 5,465,866 | A | 11/1995 | Belcastro |
| D404,613 | S | 1/1999 | Hatsumoto et al. |
| D406,006 | S | 2/1999 | Hatsumoto et al. |
| 6,098,834 | A | 8/2000 | Hatsumoto et al. |
| 6,557,717 | B1 | 5/2003 | Keck |
| 6,732,875 | B2 | 5/2004 | Smith et al. |
| 6,824,003 | B1 | 11/2004 | Wong |
| 7,275,653 | B2 | 10/2007 | Tedford, Jr. |
| D564,841 | S | 3/2008 | Clemens et al. |
| 7,413,096 | B2 | 8/2008 | Morgan et al. |
| D581,727 | S | 12/2008 | Pinelli et al. |
| D592,456 | S | 5/2009 | Pinelli et al. |

(Continued)

FOREIGN PATENT DOCUMENTS

| | | |
|---|---|---|
| WO | WO0045684 | 8/2000 |

OTHER PUBLICATIONS

Solo Traveler Plus Lid, http://catalog.renardpaper.com/catalogproductdetail.aspx?itemno=SO-TPLUS, accessed Oct. 4, 2011, and available before Aug. 26, 2011.

(Continued)

*Primary Examiner* — J. Gregory Pickett
*Assistant Examiner* — James M Van Buskirk
(74) *Attorney, Agent, or Firm* — McDermott Will & Emery LLP

(57) ABSTRACT

A locking mechanism for a trigger assembly in a lid of a drinking container is provided. In one embodiment, the locking mechanism comprises a button member, a stop and a manifold. The button member is moveable in a first direction from a first locked position to a second unlocked position. The button member is further moveable in a second direction toward an interior of the lid when the button is disposed in the second position. The button member has a locking protrusion portion. The locking protrusion portion of the button member is disposed proximate the stop in the first position, and distal the stop in the second position. The stop limits movement of the button member in the second direction with the button member disposed in the first position. A manifold is slidingly connected to the button member. The manifold is displaced by the button member when the button member is moved in the second direction. The manifold operates a seal assembly to allow fluid communication between the drink aperture and the container body.

20 Claims, 4 Drawing Sheets

U.S. PATENT DOCUMENTS

| | | | |
|---|---|---|---|
| D592,905 | S | 5/2009 | Pinelli et al. |
| D592,913 | S | 5/2009 | Pinelli et al. |
| 7,611,029 | B2 | 11/2009 | Wong |
| 2006/0081633 | A1 | 4/2006 | Schmidtner et al. |
| 2006/0226160 | A1 | 10/2006 | Elsaden |

OTHER PUBLICATIONS

Dixie Smart Top Reclosable Hot Cup Lid, http:www.greenlightoffice.com/catalog/DXETP9542.aspx?ret=%2fsearch%2fkewordsearch.aspx%3ft%3dredclosable%2blid, accessed Oct. 4, 2011, and available before Aug. 26, 2011.

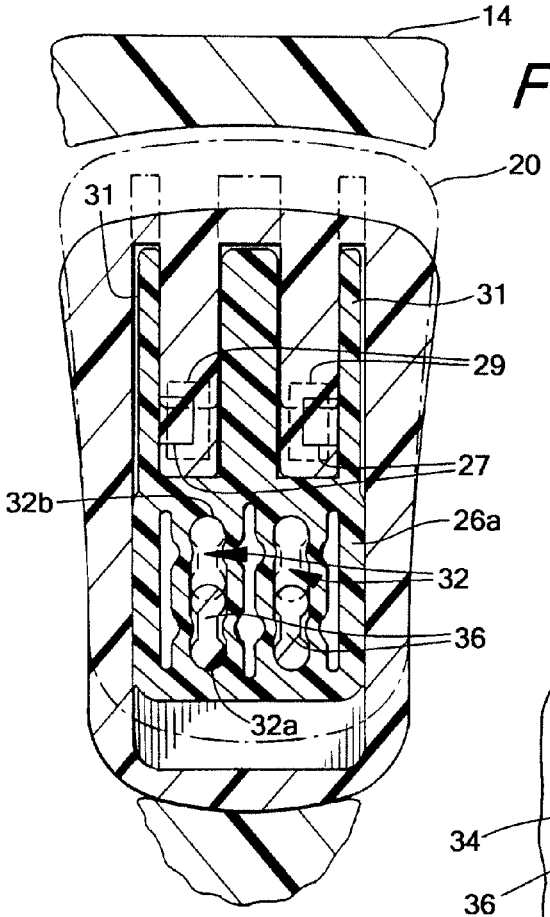
FIG. 4
FIG. 5
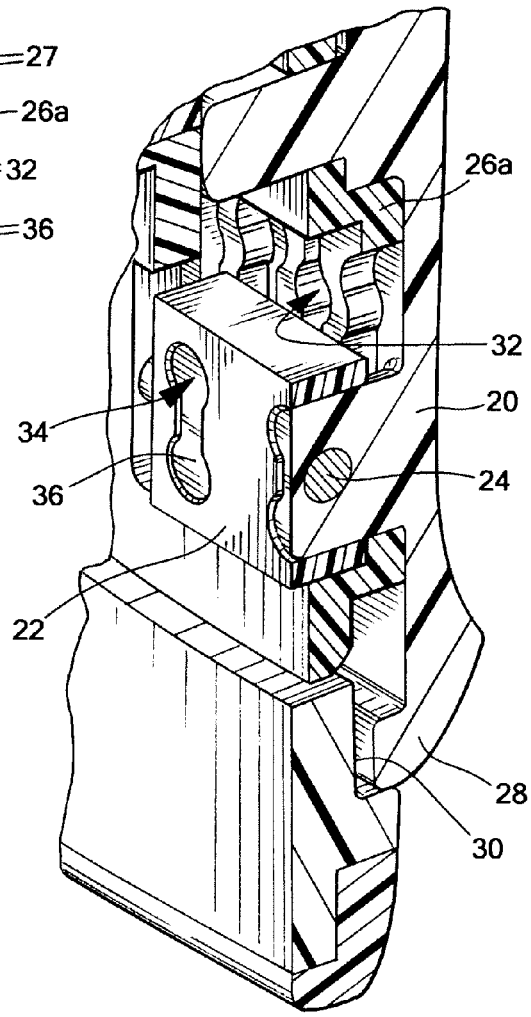

DRINKING CONTAINER HAVING LOCKING DRINKING ORIFICE AND VENT APERTURE

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates generally to drinking containers, and more particularly to sealing mechanisms and trigger mechanisms for opening and closing orifices of drinking containers.

BACKGROUND OF THE INVENTION

Drinking containers, including travel mugs, are well known in the art. While such drinking containers according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

According to one embodiment, a drinking container having a locking mechanism is provided. In one embodiment the drinking container comprises a container body having a container cavity, a removable lid covering the container cavity, and a trigger assembly. According to another embodiment, the lid has a top surface having a drink aperture and a vent aperture extending therethrough.

According to another embodiment, the trigger assembly controls fluid communication between the container cavity and the drink aperture. The trigger assembly has a button member moveable in a first direction from a first locked position to a second unlocked position, preferably about a generally longitudinal axis of the container body. The button member is prevented from movement in a second direction generally transverse to the longitudinal axis of the container body when the button member is disposed in the first locked position. The button member is moveable in the second direction generally transverse to the longitudinal axis of the container body when the button member is disposed in the second unlocked position. Movement of the button in the second direction allows fluid communication between the container cavity and the drink aperture.

According to another embodiment, the button member has a locking portion. The locking portion being adjacent a stop of the lid when the button member is disposed in the first position.

According to another embodiment, the trigger assembly has a button lock connected to the button member. In one embodiment a pin secures the button lock to the button member.

According to another embodiment, the trigger assembly further comprises a manifold, at least a portion of the manifold disposed between the button member and the button lock. In one embodiment the manifold has at least one opening formed therein, the button member has at least one protrusion extending therefrom, and the at least one protrusion of the button member passing through the at least one opening formed in the manifold and being received by the button lock. According to another embodiment, the at least one protrusion of the button member is generally bar-bell shaped, According to another embodiment, the locking mechanism comprises a stop on the lid, a button member and a manifold. The button member is moveable in a first direction from a first position, where the button member is prevented from being actuated, to a second position about the lid assembly. The button member is further moveable in a second direction when the button is disposed in the second position. The button member has a locking portion thereto, the locking portion being adjacent the stop when the button member is disposed in the first position. The button member being connected in a sliding engagement to the manifold, and the manifold operably operating a seal assembly.

According to another embodiment, movement of the button member in the first direction is generally about a longitudinal axis of the container body, and movement of the button member in the second direction is generally transverse to a longitudinal axis of the container body.

According to another embodiment, the locking portion of the button member is disposed in a position so as not to contact the stop of the lid when the button member is disposed in the second position.

According to another embodiment, the locking mechanism comprises a button member moveable in a first direction from a first position to a second position, the button member further being moveable in a second direction toward an interior of the lid when the button is disposed in the second position. The button member has a locking protrusion portion disposed proximate a locking wall in the first position. The locking wall limiting movement of the button member in the second direction with the button member disposed in the first position, and the locking protrusion portion of the button member being disposed distal the locking wall in the second position. A manifold is moveable in the second direction. The manifold is displaced by the button member when the button member is moved in the second direction. The manifold operates the seal assembly to allow fluid communication between the drink aperture and the container body.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 4 is partial front cross-sectional view showing the trigger mechanism in the first position; and FIG. 5 is a partial perspective cross-sectional view of the trigger mechanism for a drinking orifice in the first position.

DETAILED DESCRIPTION

Figure 1:
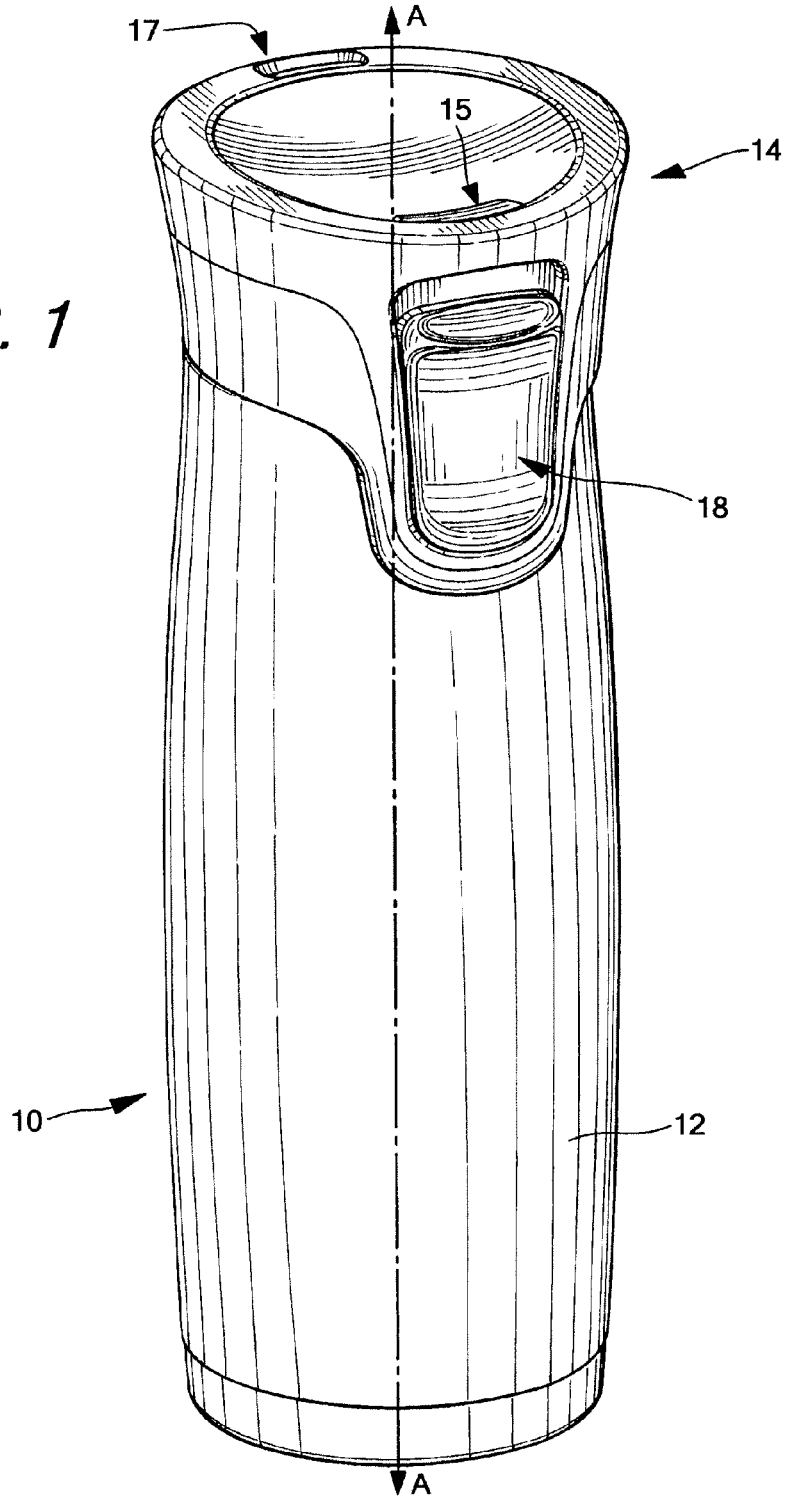
FIG. 1 is a front perspective view of one embodiment of an insulated drinking container.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, and specifically to FIG. 1, there is shown an insulated drinking container 10. The container 10 is generally comprised of a container body 12 for holding liquid, and a lid assembly 14 that can be secured to the container body 12. As explained in detail herein, the lid assembly 14 generally covers an opening to a liquid receptacle formed in the interior of the container body 12. The container 10 has a longitudinal axis A-A that extends about a length of the container 12. Additionally, in one embodiment a seal assembly 16 (FIG. 2) is provided as part of the lid assembly 14. The container 10 also includes a trigger assembly 18 that is utilized to actuate the seal assembly 16 to provide for opening and closing one or more openings for allowing liquid to be dispelled from the liquid receptacle of the drinking container 10. As shown in FIG. 1, the lid assembly 14 includes a vent 15 and a liquid opening 17 to dispense liquid and gases from the liquid receptacle.

Figure 2:
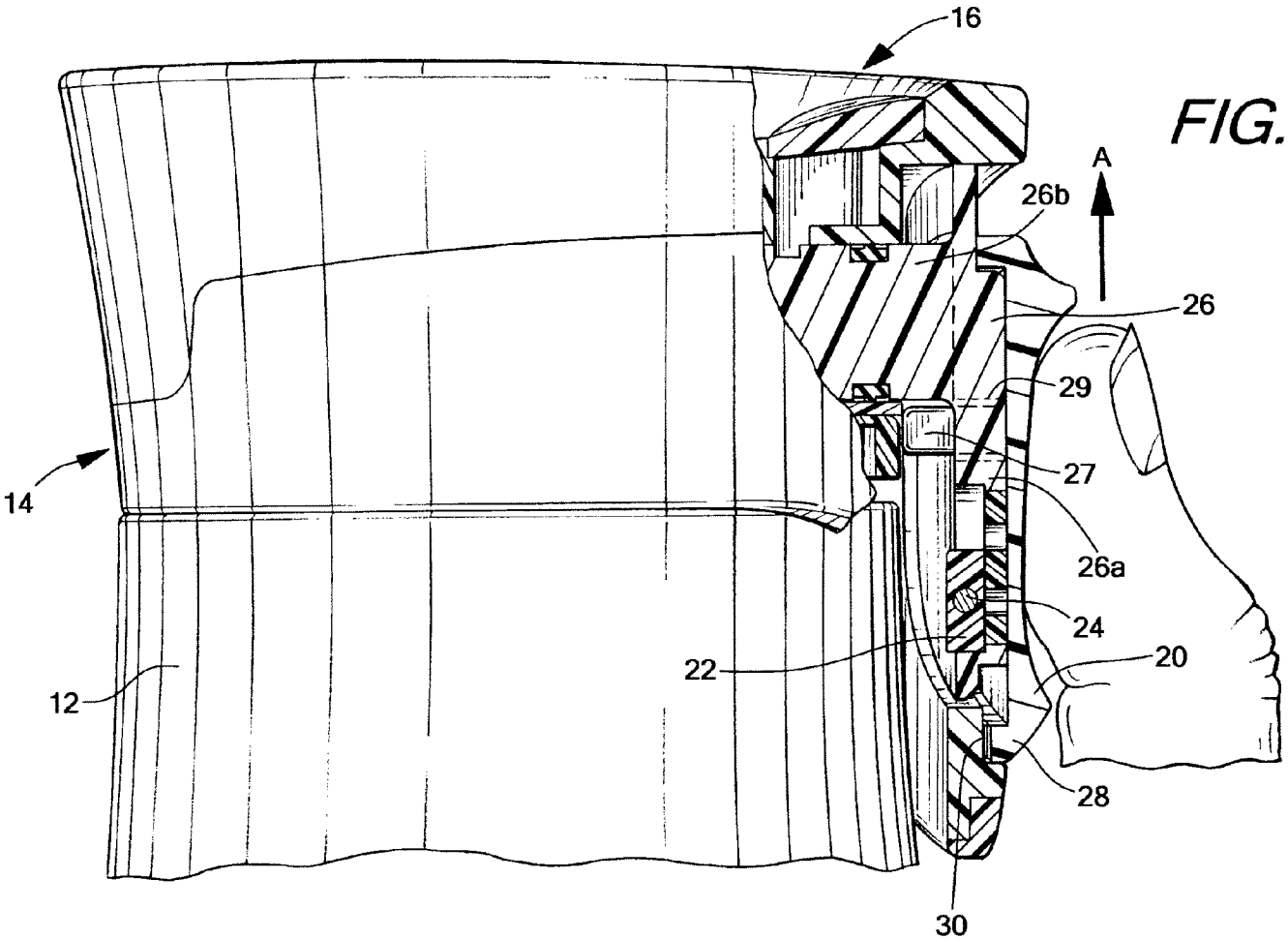
FIG. 2 is a partial cross-sectional view of a trigger mechanism for a drinking orifice in a first position.

FIG. 2 shows a partial sectional view taken through the lid assembly 14 and the seal assembly 16 to disclose a portion of the trigger assembly 18 in a first position. The trigger assembly 18 generally comprises a button member 20 and a button lock 22 connected to the button member 20 via a pin 24. The trigger assembly 18 also comprises a stop, also referred to as a locking wall 30. In one embodiment the stop 30 is a wall of the lid assembly 14. In one embodiment the button member 20 is generally movable a distance in a direction generally parallel to the longitudinal axis of the drinking container 10. Further, in one embodiment the button member 20 is moveable in a plane generally parallel to the longitudinal axis of the drinking container 10 between a first position, shown in FIG. 2, where the trigger assembly 18 is "locked" or prevented from being actuated, and a second position, shown in FIG. 3, where the trigger assembly 18 is "unlocked" or able to be actuated by the user. For locking and unlocking of the trigger assembly, in one embodiment the movement of the button member 20 is in the direction of arrow A and in the reverse direction as shown in FIG. 2. Since the button lock 22 is connected to the button member 20 in one embodiment, the button lock 22 moves with the button member 20 in a plane along the longitudinal axis of the drinking container 10 as the user moves the button member 20 between the locked and unlocked positions. While the movement of the button member 20 in the preferred embodiment is in the direction of the longitudinal axis of the container, it is understood that the button member 20 may be moved in any direction, for example to the side, at an angle, etc., to effectuate a locking engagement between the button member 20 and a stop 30 by the button member 20 being prevented from movement inwardly in the lid assembly 14.

In one embodiment the trigger assembly 18 additionally comprises a manifold 26. As seen in FIG. 2, a first portion 26*a* of the manifold 26 is sandwiched between the button member 20 and the button lock 22 of the trigger assembly 18, and a second or transverse portion 26*b* of the manifold 26 extends into a central portion of the lid assembly 14 to operate the trigger mechanisms and seals thereof. In one embodiment a pair of tabs 27 extends from the button member 20 and through receiving apertures 29 (see FIG. 4) in the manifold 26. The tabs 27 have a portion thereto which engages the manifold 26 to secure the button member 20 to the manifold 26 in a sliding engagement to allow, in a secured engagement and as is further described herein, the button member 20 to slide on the manifold 26 in the direction of arrow A, and in the reverse direction, to lock and unlock the trigger assembly 18. The transverse portion 26*b* of the manifold 26 is part of a seal release mechanism, such as a seal release mechanism described more fully in U.S. patent application Ser. No. 12/456,192 which is incorporated herein by reference. When the button member 20 is positioned in the unlocked position the manifold 26 is displaceable with the trigger assembly 18 along an axis generally transverse to the longitudinal axis of the drinking container 10, such as the direction of arrow B as shown in FIG. 3.

A portion of the button member 20 is defined as a locking member 28. In one embodiment the locking member 28 is a portion of the button member 20 that extends downwardly from the button member 20 and is disposed adjacent a locking wall 30 of the lid 14 when the button member 20 is in the first position (i.e., FIG. 2). Thus, as shown in FIG. 2, when the button member 20 is positioned in the first or locked position the locking member 28 portion of the button member 20 contacts the locking wall 30 of the lid 14, preventing or restricting the button member 20 from moving in a direction generally transverse to the longitudinal axis of the drinking container 10. By preventing the button member 20 from movement inward into the lid the manifold 26 is prevented from being displaced and thus the trigger assembly 18 is maintained in its fixed closed position. Put another way, as shown in FIG. 2, in the locked position the locking member 28 will contact the locking wall 30 to restrict movement of both the button 20 and the manifold 26 in the direction generally transverse to the longitudinal axis of the drinking container 10. In this locked position the seal assembly 16 will be in a sealed position, preventing the flow of fluid from the drinking container 10.

Figure 3:
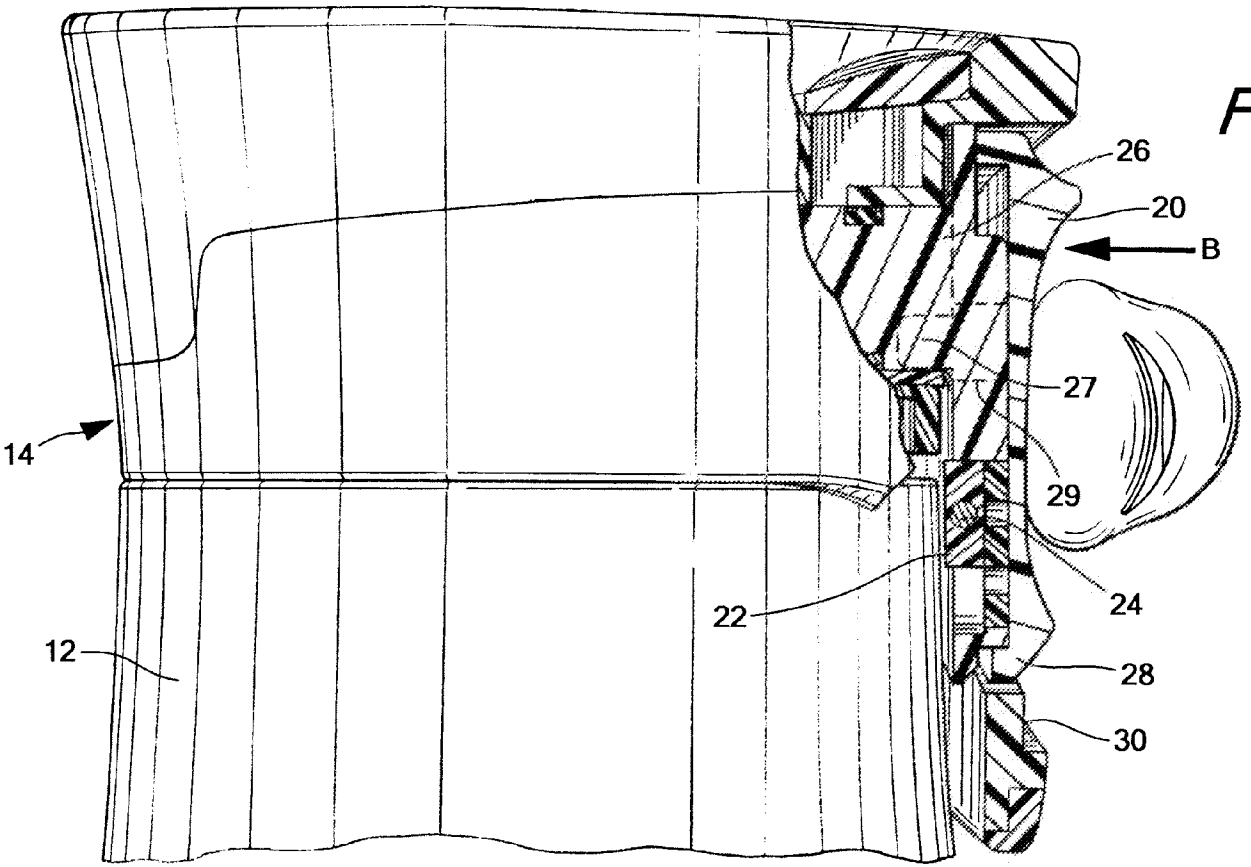
FIG. 3 is a partial cross-sectional view of a trigger mechanism for a drinking orifice in a second position.

Turning now to FIG. 3, the trigger assembly 18 is shown in the unlocked position. To transition the trigger assembly 18 from the locked position, as shown in FIG. 2, to the unlocked position, as shown in FIG. 3, the button 20 is first moved to the second position, shown in FIG. 3, along the longitudinal axis of the drinking container 10 in the direction of arrow A. In the second or unlocked position the locking portion 28 of the button 20 has been moved along the longitudinal axis of the drinking container 10 to its second position that has a different location along the longitudinal axis of the drinking container 10 than in the first position. In the second position the button member 20 is clear of the locking wall 30. Once the locking member 28 of the button 20 has been moved to a position that is clear of the locking wall 30, the button 20 may be moved in a direction generally transverse to the longitudinal axis of the drinking container 10, such as in the direction of arrow B as shown in FIG. 3.

The movement of the button 20 in the direction of arrow B causes the trigger assembly 18, including the manifold 26, to be displaced in the direction generally transverse to the longitudinal axis of the drinking container 10 (i.e., towards an interior portion of the lid assembly 14). The movement of the manifold 26 causes the seal assembly 16 to be positioned to allow fluid communication between the inside of the drinking container 10 and the vent 15 and the liquid opening 17 provided within the lid assembly 14. Therefore, once the button 20 has been displaced to a position as shown in FIG. 3 by moving the button 20 both in a direction generally parallel to the longitudinal axis of the drinking container 10 (i.e., to the unlocked position) and in a direction generally normal to the longitudinal axis of the drinking container 10 (i.e., to actuate the trigger assembly 18), the contents of the drinking container 10 may pass through the liquid opening 17 of the lid assembly 14. Further, in the position shown in FIG. 3, the vent 15 of the lid assembly 14 also allows fluid communication with the interior of the drinking container 10. As described in U.S. patent application Ser. No. 12/456,192, in one embodiment the actuation of the trigger assembly 18 allows pressure to be released from the drinking container 10 both prior to and as fluid flows out through the liquid opening 17.

FIG. 4 shows a partial front sectional view taken through the button 20 and the manifold 26 depicting the button 20 in both the first position (solid lines) and the second position (phantom lines). In one embodiment, the button member 20 has a protrusion 36 that extends from the button member 20 and through an opening 32 in the manifold 26. In a preferred embodiment the opening 32 is a bar-bell shaped opening and the manifold 26 has at least one bar-bell shaped opening 32. Further, in a preferred embodiment the protrusion 36 is a bar-bell shaped protrusion and the button member 20 has a corresponding number of bar-bell shaped protrusions 36. In one embodiment the bar-bell shaped protrusion 36 on the button member 20 passes through the bar-bell shaped opening 32 of the manifold 26. The bar-bell shaped opening 32 of the manifold 26 may limit the movement of the protrusion 36, and thus movement of the button 20, in the direction of the longitudinal axis of the drinking container 10, such that the bar-bell shaped protrusion 36 on the button member 20 contacts a distal end 32*a* of the bar-bell shaped opening 32 with the button in the first position, and the bar-bell shaped protrusion 36 on the button member 20 contacts a proximal end 32*b* of the bar-bell shaped opening 32 with the button in the second position. Additionally, because of the geometry of the bar-bell shaped openings 32 and bar-bell shaped protrusions 36, in a preferred embodiment the mating of the protrusions 36 in the openings 32 is done in snap locking manner when moving from the first position to the second position, and in the reverse direction, to maintain the button member 20 in the locked and unlocked position until a sufficient force is applied by the user to transition the button to the other position. In this manner the button 20 will remain stationary in its position until the user moves the button 20. The manifold 26 also has rails 31 on which the button 20 rides to maintain the button 20 in the proper orientation with respect to the manifold 26.

FIG. 5 shows a partial cross-sectional view of the trigger assembly 18 and a portion of the lid 14 with the button 20 in the first position. FIG. 5 additionally displays the connection of the button lock 22 to the button member 20 in a preferred embodiment. In this embodiment the button lock 22 also has a corresponding number of bar-bell shaped openings 34 to receive the corresponding number of bar-bell shaped protrusions 36 extending from the button member 20. In one embodiment the bar-bell shaped openings 32 of the manifold 26 aligns with the openings 34 formed in the button lock 22. The bar-bell shaped protrusions 36 of the button member 20 are disposed through the openings 32 in the manifold 26 and into the openings in the button lock 22 to fix the button lock 22 to the button member 20. FIG. 5 additionally shows a pin 24 passing through the button lock 22 and the protrusions 36 to secure the button lock 22 to the button member 20.

As can also be clearly observed from FIG. 5, the manifold 26 is at least partially disposed between the button member 20 and the button lock. This allows the button member 20 to be connected in a sliding arrangement to the manifold 26. Additionally, disposing at least a portion of the manifold 26 between the button member 20 and the button lock 22 allows the manifold 26 to also receive a force from the button member 20 when the button member 20 is moved by the user in the direction of Arrow B (FIG. 3), helping to move the manifold 26 in a generally transverse direction to the longitudinal axis of the drinking container 10 to cause the seal assembly 16 to be positioned to allow fluid communication between the inside of the drinking container 10 and the vent 15 and the liquid opening 17 provided within the lid assembly 14.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A drinking container comprising:

a container body having a container cavity, a removable lid covering the container cavity, the lid having a top surface having a drink aperture and a vent aperture extending therethrough;

a trigger assembly controlling fluid communication between the container cavity and the drink aperture, the trigger assembly having a button member moveable from a first locked position to a second unlocked position about a generally longitudinal axis of the container body, the button member being prevented from movement in a second direction generally transverse to the longitudinal axis of the container body with the button member disposed in the first locked position, the button member moveable in a second direction generally transverse to the longitudinal axis of the container body with the button member disposed in the second unlocked position, the movement of the button in the second direction allowing fluid communication between the container cavity and the drink aperture.

2. The drinking container of claim 1, wherein the trigger assembly further comprises a button lock connected to the button member.

3. The drinking container of claim 2, further comprising a pin securing the button lock to the button member.

4. The drinking container of claim 1, further comprising a vent aperture in the top surface of the lid, the trigger assembly controlling fluid communication between the container cavity and the drink aperture and the vent aperture.

5. The drinking container of claim 1, wherein the trigger assembly further comprises a manifold, the button being slidingly secured to the manifold.

6. The drinking container of claim 2, wherein the trigger assembly further comprises a manifold, at least a portion of the manifold disposed between the button member and the button lock.

7. The drinking container of claim 6, wherein the manifold has at least one opening formed therein, wherein the button member has at least one protrusion extending therefrom, the at least one protrusion passing through the at least one opening formed in the manifold and being received by the button lock.

8. The drinking container of claim 7, wherein the at least one protrusion of the button member is generally bar-bell shaped.

9. The drinking container of claim 1, wherein the button member has a locking portion thereto, the locking portion being adjacent a stop of the lid when the button member is disposed in the first position.

10. A locking mechanism for a drinking container having a container body defining a container cavity, and a lid covering the container cavity, the locking mechanism comprising:

a stop on the lid;

a button member moveable in a first direction from a first position, where the button member is prevented from being actuated, to a second position about the lid assembly, the button member further being moveable in a second direction when the button is disposed in the second position, the button member having a locking portion thereto, the locking portion being adjacent the stop when the button member is disposed in the first position and, a manifold, the button member being connected in a sliding engagement to the manifold, the manifold operably operating a seal assembly.

11. The locking mechanism of claim 10, further comprising a button lock connected to the button member and moveable with the button member.

12. The locking mechanism of claim 10, wherein the movement of the button member in the first direction is generally about a longitudinal axis of the container body, and wherein the movement of the button member in the second direction is generally transverse to a longitudinal axis of the container body.

13. The locking mechanism of claim 10, wherein the locking portion of the button member is disposed in a position so as not to contact the stop of the lid when the button member is disposed in the second position.

14. A locking mechanism for a drinking container having a container body defining a container cavity, and a lid covering the container cavity, the lid having a seal assembly to control fluid communication between a drink aperture and the container body, the locking mechanism comprising:

a button member moveable in a first direction from a first position to a second position, the button member further being moveable in a second direction toward an interior of the lid when the button is disposed in the second position, the button member having a locking protrusion portion;

the locking protrusion portion of the button member disposed proximate a locking wall in the first position, the locking wall limiting movement of the button member in the second direction with the button member disposed in the first position, the locking protrusion portion of the button member being disposed distal the locking wall in the second position; and, a manifold moveable in the second direction, the manifold being displaced by the button member when the button member is moved in the second direction, the manifold operating the seal assembly to allow fluid communication between the drink aperture and the container body.

15. The locking mechanism of claim 14, wherein the first direction of movement of the button member is about a generally longitudinal axis of the container body, and wherein the second direction of movement of the button member is generally transverse to the longitudinal axis of the container body.

16. The locking mechanism of claim 14, further comprising a button lock connected to the button member and moveable with the button member.

17. The locking mechanism of claim 16, wherein at least a portion of the manifold is disposed between the button lock and the button member.

18. The locking mechanism of claim 16, further comprising a pin connecting the button lock to the button member.

19. The locking mechanism of claim 14, wherein the button member is slidingly connected to the manifold.

20. The locking mechanism of claim 14, wherein an opening in the manifold limits movement of the button member in the first direction.

* * * * *